US009192870B2

(12) United States Patent
Chapman-Rickman

(10) Patent No.: US 9,192,870 B2
(45) Date of Patent: Nov. 24, 2015

(54) BALLOON ARRANGEMENT

(71) Applicant: Lorna M. Chapman-Rickman, Roseville, CA (US)

(72) Inventor: Lorna M. Chapman-Rickman, Roseville, CA (US)

( * ) Notice: Subject to any disclaimer, the term of this patent is extended or adjusted under 35 U.S.C. 154(b) by 5 days.

(21) Appl. No.: 14/164,090

(22) Filed: Jan. 24, 2014

(65) Prior Publication Data

US 2015/0213742 A1 Jul. 30, 2015

(51) Int. Cl.
*A63H 3/06* (2006.01)
*A63H 27/10* (2006.01)

(52) U.S. Cl.
CPC ..... *A63H 27/10* (2013.01); *A63H 2027/1041* (2013.01)

(58) Field of Classification Search
USPC ..... 446/220, 221, 222, 223, 225, 226; 211/13.1
See application file for complete search history.

(56) References Cited

U.S. PATENT DOCUMENTS 3,366,999 A * 2/1968 Darby ..... 446/222
4,944,709 A * 7/1990 Lovik ..... 446/221
4,953,713 A * 9/1990 Yaffe ..... 211/13.1
5,036,985 A * 8/1991 Lovik ..... 211/13.1
5,564,575 A * 10/1996 Casement ..... 211/13.1
5,755,419 A * 5/1998 Gearhart et al. ..... 248/346.01
5,769,685 A * 6/1998 Nakamura et al. ..... 446/221
5,797,783 A 8/1998 Harris
6,394,873 B1 * 5/2002 Bernard ..... 446/220
6,478,651 B1 11/2002 Weir
6,655,057 B2 * 12/2003 Kim ..... 40/212
7,507,137 B1 * 3/2009 Rouse ..... 446/220
8,444,098 B2 * 5/2013 Parello et al. ..... 248/218.4
8,568,190 B2 * 10/2013 Nelson et al. ..... 446/220
2003/0148701 A1 * 8/2003 Turjanmaa ..... 446/220
2007/0037473 A1 * 2/2007 Long ..... 446/220
2008/0121309 A1 5/2008 Boise et al.
2010/0178841 A1 * 7/2010 Finelli ..... 446/222

* cited by examiner

*Primary Examiner* — Kurt Fernstrom
(74) *Attorney, Agent, or Firm* — Ariel S. Bentolila; Bay Area IP Group LLC

(57) ABSTRACT

A balloon arrangement comprises a base member. At least one stem unit is configured for removably engaging the base member. At least one balloon hoop unit is configured for removably engaging the stem unit. The balloon hoop unit comprises a hoop portion that is configured to rotate from a substantially flat position for storage to a substantially horizontal position for supporting a balloon. The balloon hoop unit further comprises a self-sealing balloon tie portion that is configured for sealing a tail of a balloon. At least one balloon is operable to be inflated by breathable air in which the self-sealing balloon tie portion seals a tail of the balloon inflated with the breathable air. The hoop portion, in the supporting position, supports the balloon inflated with the breathable air in a position for simulating being held up by helium inflation.

20 Claims, 12 Drawing Sheets

BALLOON ARRANGEMENT

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to balloon arrangements. More particularly, the invention relates to an air-filled (helium free) balloon arrangement assembly kit.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Helium balloon arrangements may be frequently used as decorations at celebratory events and occasions or may be presented as gifts. Currently, it is believed that helium is a non-renewable element, which may run out as soon as within the next 20 years. Moreover, helium may be used for a variety of medical, scientific, and commercial uses. One may expect that these factors may result in reluctance to use helium for applications that may be seen as frivolous, for example, without limitation, in helium balloons. As helium gas for non-commercial usage becomes less abundant, more expensive, and more restricted, one may expect that it may become more difficult to find helium balloons for parties, decorations, and special events.

By way of educational background, an aspect of the prior art generally useful to be aware of is that there are currently available balloon sticks and cups that may be used to make balloon arrangements. Standard balloon cups may be bulky and difficult or expensive to ship. Furthermore, current balloon cups generally require the user to tie the tail of the balloon in order to seal the balloon, which may be difficult or tedious for some users.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 is a diagrammatic front view, and FIG. 2 is a side perspective view;

FIG. 3 is an exploded side perspective view of the stem system. FIG. 4 is a side perspective view of the stem system as assembled, and FIG. 5 is an exploded side perspective view of a connection point from the stem system;

FIG. 7 is a side perspective view, and FIG. 8 is a side perspective view including, without limitation, a streamer assembly;

Figure 1:
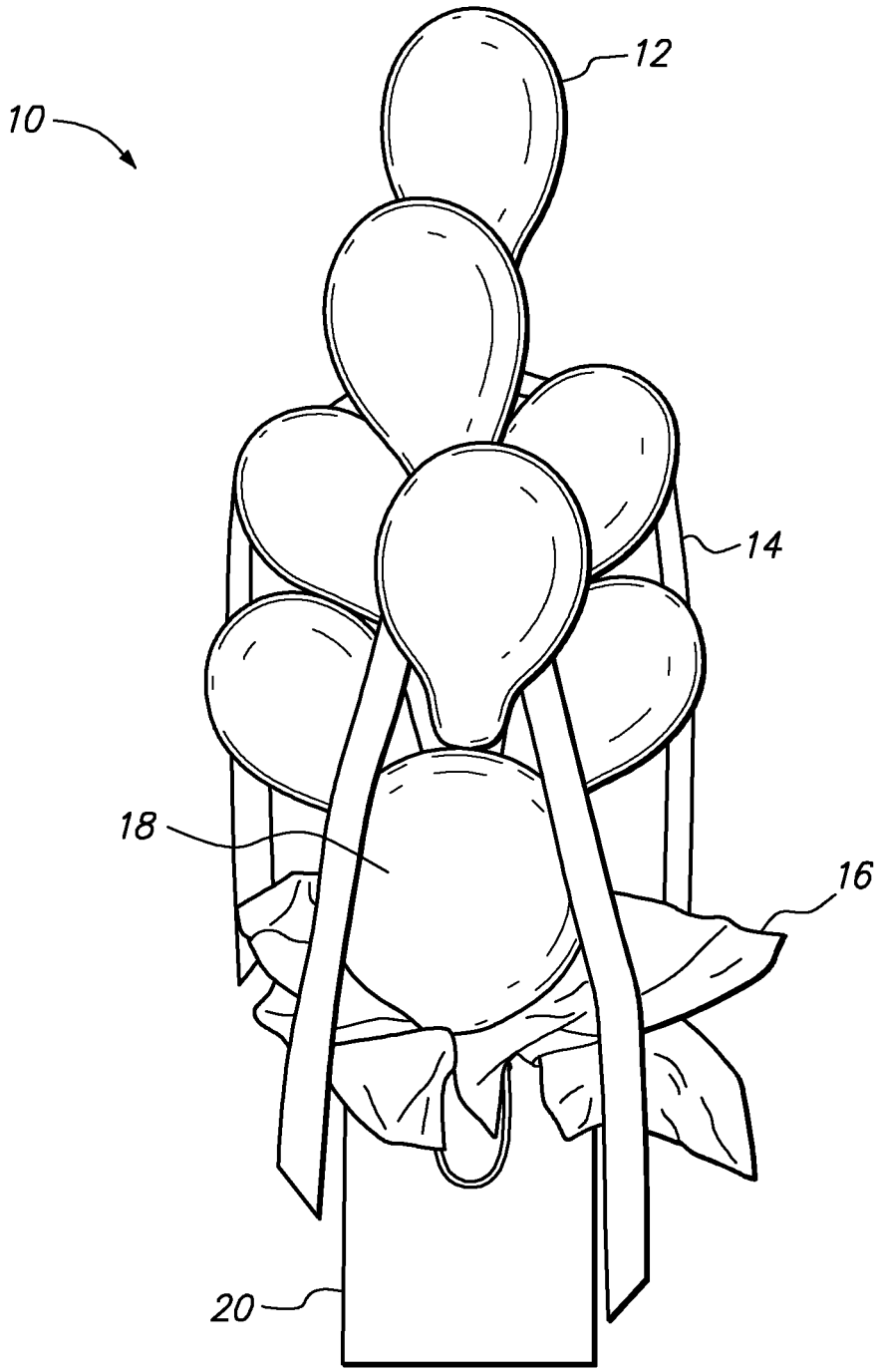
FIG. 1 and FIG. 2 illustrate an exemplary balloon arrangement as a fully assembled package, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide an air-filled, self-contained, do-it-yourself balloon display kit that does not use helium gas. Some embodiments may comprise a stem supported construction design, which may replace the need for helium gas. This may offer the public the ability to enjoy celebration balloon arrangements while conserving the helium supply.

Figure 2:
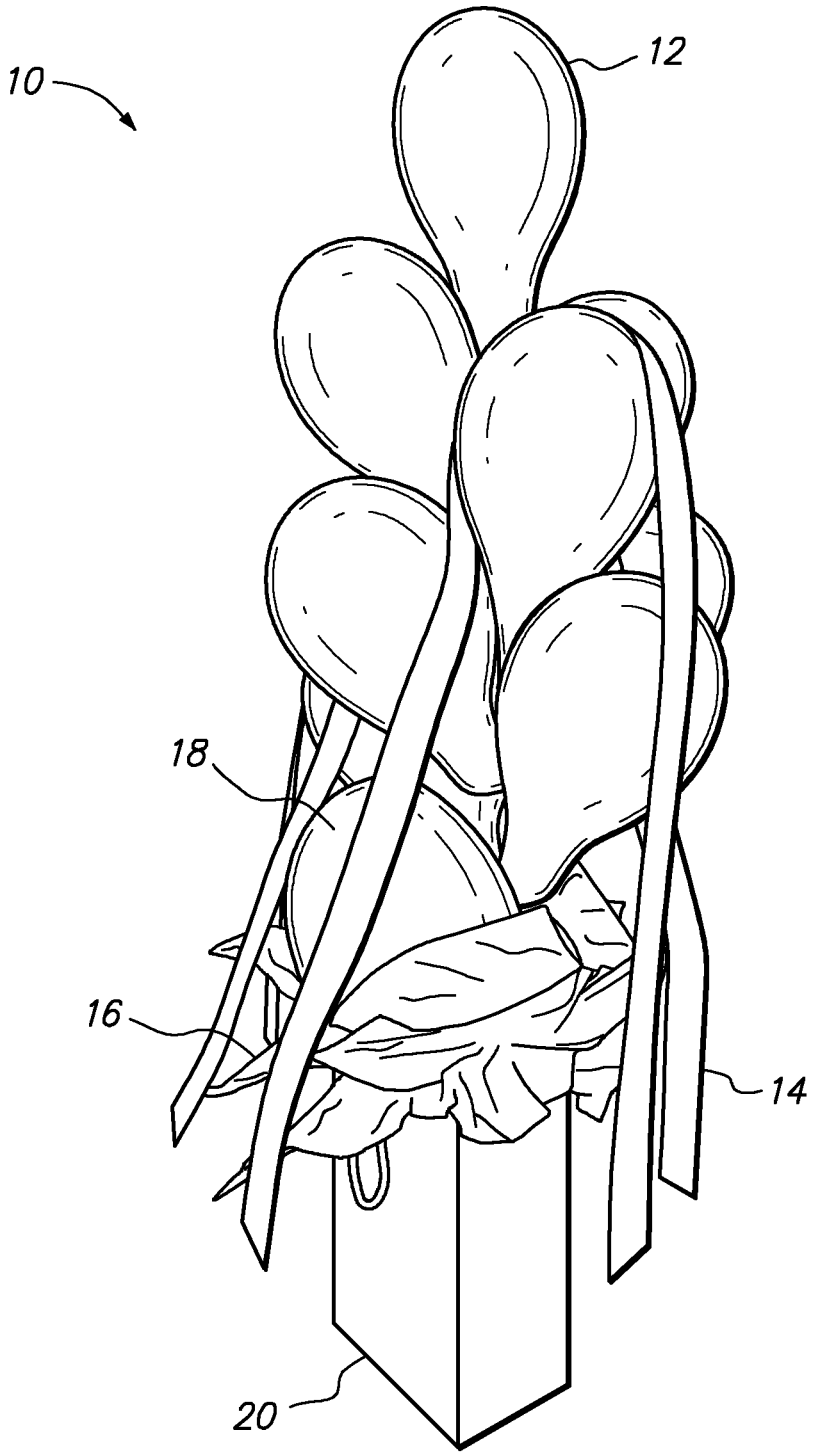

FIG. 1 and FIG. 2 illustrate an exemplary balloon arrangement 10 as a fully assembled package, in accordance with an embodiment of the present invention. FIG. 1 is a diagrammatic front view, and FIG. 2 is a side perspective view. In the present embodiment, arrangement 10 comprises multiple latex balloons 12 and a decorative balloon 18 made of a polyester film such as, but not limited to, Mylar®. Balloons 12 and 18 are filled with air and supported with a snap together plastic stem system, illustrated by way of example in FIGS. 3 through 6, which may hold balloons 12 and 18 in upright positions that look as if balloons 12 and 18 are being held up by helium without the use of helium.

In the present embodiment, a gift bag 20 is used as the holding container. It is contemplated that arrangement 10 may be placed in a different type of container such as, but not limited to, a flower pot, a decorated box, a vase, decorative bowls, etc. Almost anything that the base of arrangement 10 can fit into may be used to house the balloon arrangement package. Arrangement 10 may be used as a gift bag for cookies, candy, or a special present. Furthermore, arrangement 10 may serve as a centerpiece or table decoration, a floor arrangement, a party decoration, etc. Streamers 14 and tissue paper 16 may be inserted into gift bag 20 as embellishments. It is contemplated that balloon arrangements in some alternate embodiments may be assembled into many different configurations. For example, without limitation, the number and type of balloons in the arrangement may vary. Also, depending on the purpose of the balloon arrangement, additional tissue paper 16 and/or streamers 14 be added to the assembly to make it look more festive. Moreover, a multiplicity of suitable decorative materials may be used in some arrangements such as, but not limited to, floral moss, Easter grass, shredded foil, etc. Some embodiments may comprise a supplemental music and recording module chip that may be programmed to play a personal message, a special event message, or a song. Other embodiments may comprise various different types of sound producing devices to add sound to the arrangement if desired. Yet other embodiments may also be implemented with flashing lights or glowing elements including, but not limited to, LEDs, fiber optics, glow in the dark embellishments, embellishments comprising luminescent chemicals, etc.

Figure 3:
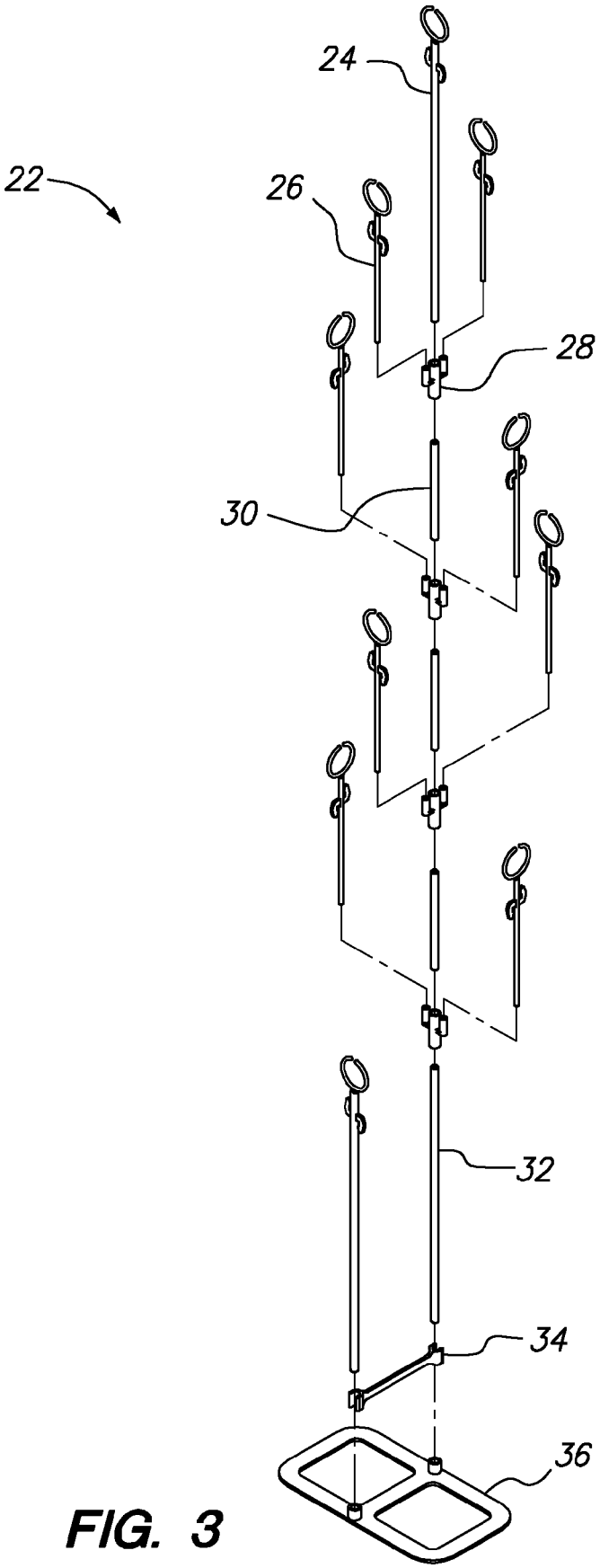
FIG. 3, FIG. 4, and FIG. 5 illustrate an exemplary stem system for a balloon arrangement assembly, in accordance with an embodiment of the present invention.
Figure 4:
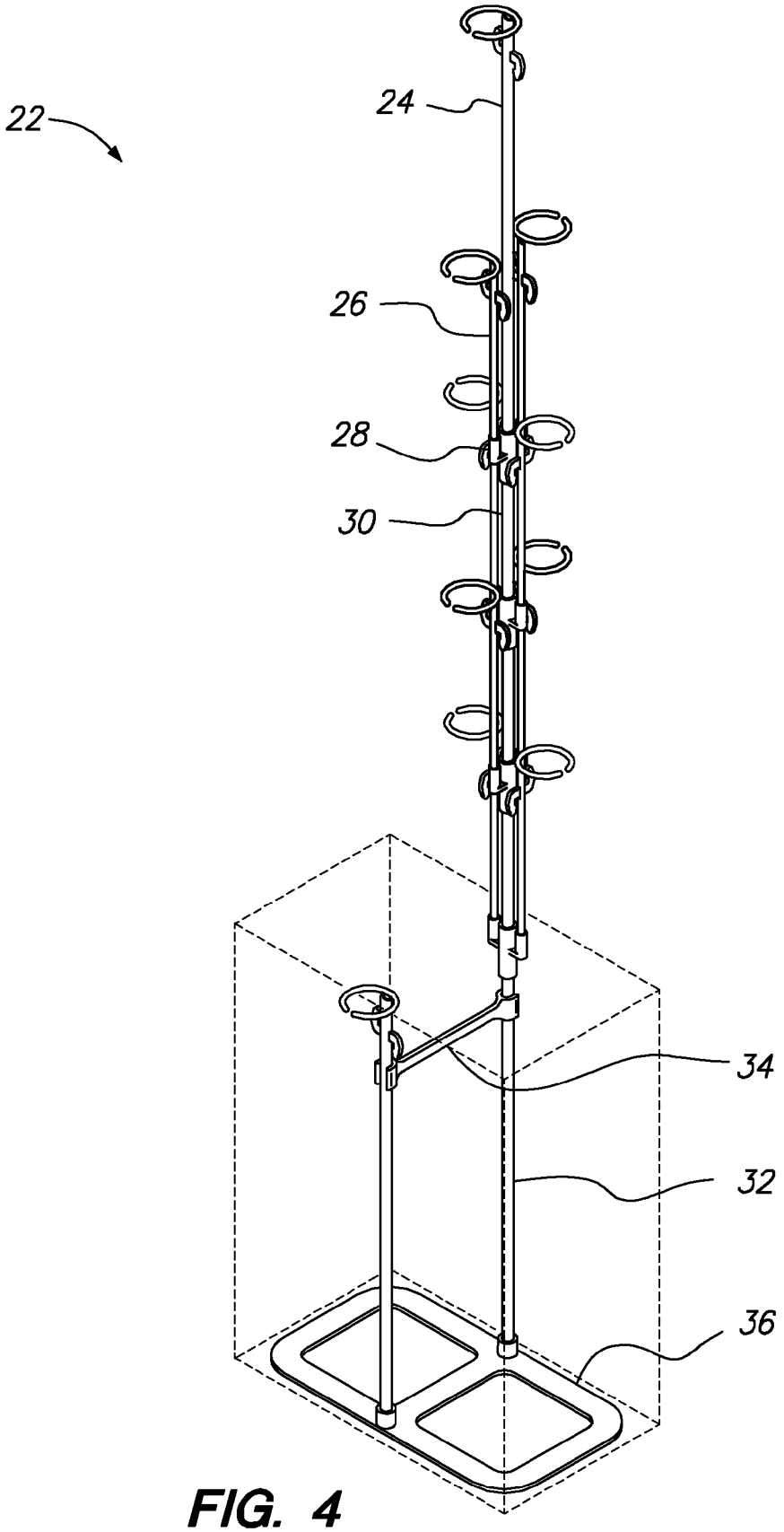
Figure 5:
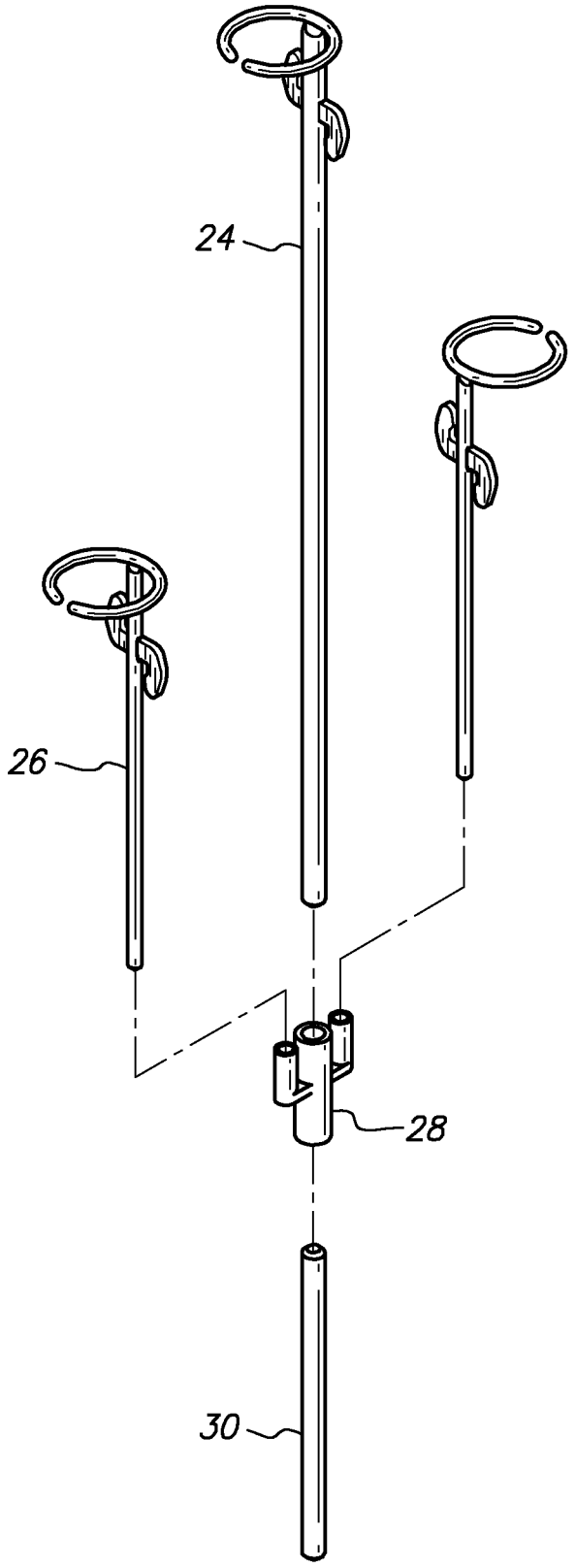

FIG. 3, FIG. 4, and FIG. 5 illustrate an exemplary stem system 22 for a balloon arrangement assembly, in accordance with an embodiment of the present invention. FIG. 3 is an exploded side perspective view of stem system 22. FIG. 4 is a side perspective view of stem system 22 as assembled, and FIG. 5 is an exploded side perspective view of a connection point from stem system 22. In the present embodiment, stem system 22 comprises a base 36, a long stem 32, two long hoops 24, four connectors 28, three short stems 30, and eight short hoops 26. A horizontal support 34 connects long stem 32 to a single long hoop 24 near the location where long stem 32 and a long hoop 24 connect to base 36. Referring to FIG. 4, in the present embodiment, stems 30 and 32 and hoops 24 and 26 may be snapped together with connectors 22 to create self-supporting stem system 22.

Referring to FIG. 5, in the present embodiment, connectors 28 comprise a center tube into which long stem 32 and short stems 30 may be inserted to create a vertical support. Connectors 28 also comprise a small tube protruding from each side of the larger tube into which long hoops 24 or small hoops 26 may be inserted. The tubes of connectors 28 are situated in a straight line. It is contemplated that in some embodiments, connectors may be implemented with fewer or more connection tubes or with tubes situated in various different configurations. For example, without limitation, the connection tubes in some embodiments may be situated at an angle to each other rather than in a straight line. Referring to FIG. 4, in the present embodiment, connectors 28 are positioned on short stems 30 and long stem 32 so that the orientation of the line of connector tubes is rotated 90-degrees at each connection to create a crisscrossed, staggered arrangement. Stem system 22 may enable a user to place base 36 in a container and create a balloon arrangement with a portion of stem system 22 which protrudes from the container. Some embodiments, in which the container for the arrangement is designed to support the stems, may be implemented without a base for the stem system. For example, without limitation, in one such embodiment, the container may comprise tabs or apertures on the inside into which the stem or stems of the stem system may fit.

In the present embodiment, the parts of stem system 22 may be made of plastic to be lightweight and also may be designed to be packaged compactly in a kit for easy and cost effective shipping. Once such design characteristic is the implementation of foldable hoops 24 and 26. Referring to FIG. 3, for packaging and/or shipping, hoops 24 and 26 are typically in a flat configuration. Referring to FIG. 4 and FIG. 5, when ready for use, hoops 24 and 26 fold down to create a support for balloons as illustrated by way of example in FIG. 7. For assembly, hoops 24 and 26 and stems 30 and 32 may be snapped together and connected to base 36 to create self-supporting stem system. Hoops 24 and 26 may be folded before or after assembly of stem system 22. It is contemplated that the stems in some embodiments may be implemented with various different types of supports for balloons including, without limitation, standard balloon cups, clamps, adhesive pads, hooks, slots, etc. In the present embodiment, the parts of stem system 22 may be made from lightweight, clear molded plastic, which may enable attached balloons to look like they are helium filled balloons floating on string despite being filled with air. Those skilled in the art will readily recognize, in light of and in accordance with the teachings of the present invention, that stems systems in some alternate embodiments may be made from a multiplicity of suitable materials such as, but not limited, to, plastic of various different colors, plastic tubing, metal, wire, etc.

Figure 6:
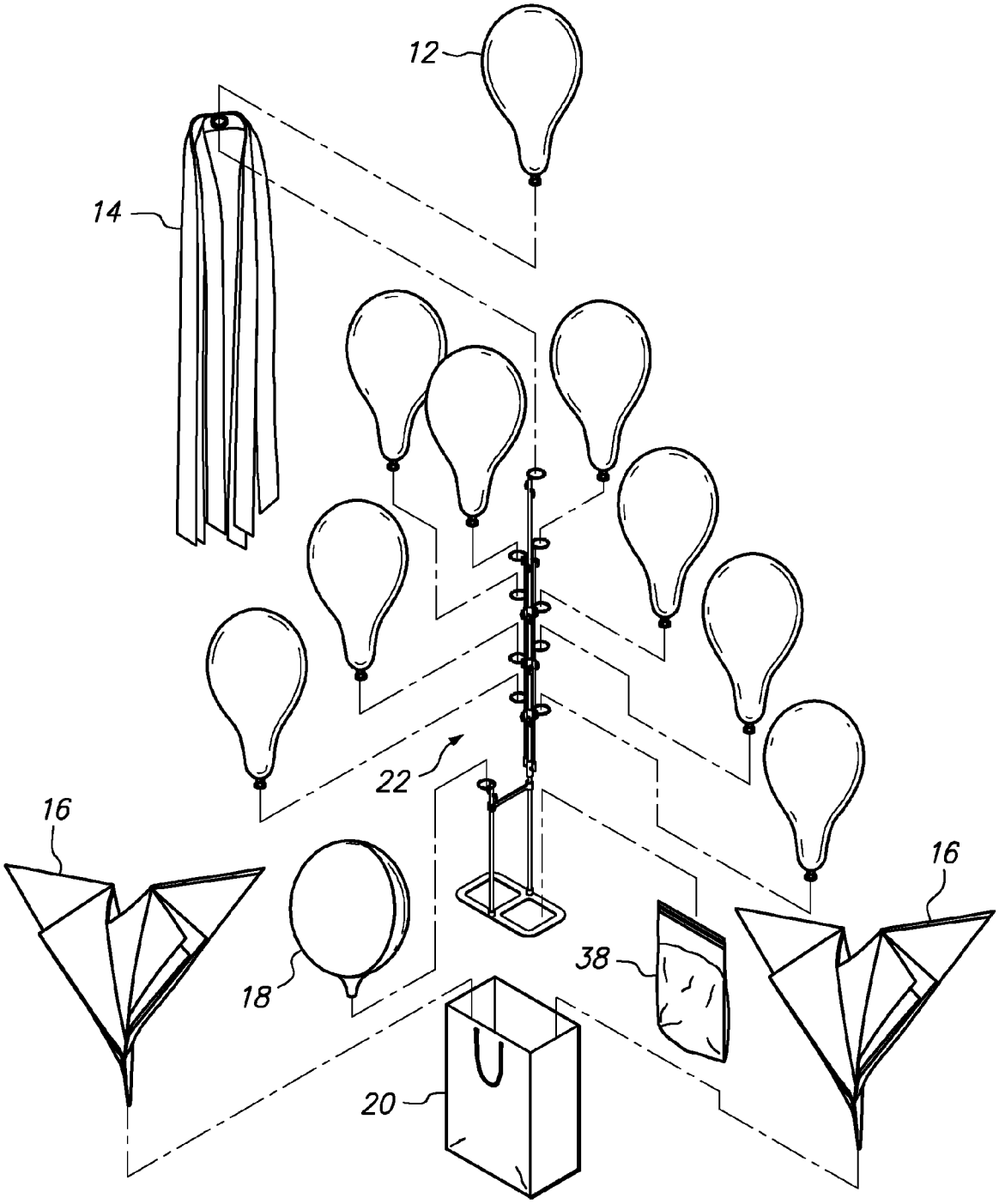
FIG. 6 is an exploded side perspective view of an exemplary balloon arrangement package, in accordance with an embodiment of the present invention.

FIG. 6 is an exploded side perspective view of an exemplary balloon arrangement package, in accordance with an embodiment of the present invention. In the present embodiment, the package may be provided as an unassembled air-filled (helium free) do-it-yourself balloon arrangement assembly kit. The kit would include the stem system FIG. 3-22, as illustrated by way of example in FIG. 3 and FIG. 4. Once a stem system-22 is assembled as illustrated by way of example in FIG. 4, stem system 22 may be placed in a container to hide the base assembly of stem system 22, such as, but not limited to, a gift bag 20, a flower pot, a ceramic vase, etc. Then, a weight 38 may be placed in gift bag 20 on top of the base assembly, to aid in supporting stem system 22 and maintaining the balloon arrangement in an upright position to simulate being held up by helium. In the present embodiment, weight 38 may be a bag filled with a dry polymer powder. To create the necessary weight to anchor the balloon assembly, the user may add water to the bag of polymer powder. The use of polymer powder may enable weight 38 to be lightweight and easy to ship and store before water is added. In some embodiments, various different types of items may be used as the weight or the end user may provide the balloon weight. For example, without limitation, a gift, a rock, or a bag of candy, chocolates, cookies, may be used as the weight. After stem system 22 is anchored, latex balloons 12 and a decorative balloon 18 may be added to the hoops of stem system 22. As balloons 12 and 18 are inflated, the tail of each balloon may be twisted through a self-sealing portion of the hoops of stem system 22, as illustrated by way of example in FIG. 7. Optionally, streamers 14 may be attached to stem assembly by; running the tail of an inflated balloon through a grommet in streamers 14 before looping the tail through the self-sealing hoop. Streamers 14 may be made of a decorative material including, without limitation, polyester film such as, but not limited to, Mylar®, crepe paper, ribbon, paper, plastic, etc. Tissue paper decorations 16 may be folded such that they may be easily positioned in the arrangement. Tissue paper decorations 16 may comprise multiple sheets of paper in colors coordinating with the color of balloons 12 and 18, sheets of plastic, sheets of polyester film, etc. Some alternate embodiments may be implemented without streamers or tissue paper decorations.

Those skilled in the art will readily recognize, in light of and in accordance with the teachings of the present invention, that some embodiments may be implemented with a multiplicity of suitable several balloon counts and configurations and various different decorative accessories. In the present embodiment, the balloon assembly comprises nine latex balloons and one decorative balloon, which generally ensures that the entire stem system 22 is covered. The count of balloons may be increased or decreased depending on the application and the size of balloons being used. The main consideration is to use an even crisscross staggered arrangement. One small configuration may comprise one base, one long stem, two long hoops, one connector, and two short hoops to create a balloon arrangement with three latex balloons and one decorative balloon. Some embodiments may comprise as few as three balloons or as many as the assembly may physically support. Some embodiments may be reinforced to support more balloon weight. Some embodiments may have a decorative base so that a container may not be needed. Furthermore, some embodiments may not comprise streamers or tissue paper decorations or may comprise various different types of additional or alternative decorative accents such as, but not limited to, LED lighting, stuffed animals, artificial or live flowers, confetti, glowing items, plastic or paper "grass", garland, etc.

Some embodiments may have a decorative base so that a container may not be needed. The balloon arrangement package with the decorative base once assembled may set on the floor or table. It may a variety of slots, holes, connectors, and folding hoops that can be used in a various ways to create the desired balloon shapes and configurations. In some embodiments, the decorative base may be stacked, or used individually to create a decorative support for a variety of balloon arrangements. Some embodiments may use the decorative balloon base in place of the gift bag 20 shown in FIG. 6. In some embodiments, the decorative base may have various slots, holes, and connectors that are aligned to allow the assembled stem system 22, shown in FIG. 4.

In the present embodiment the clear plastic components of stem system 22 may give the illusion of being invisible and are typically lightweight to generally make balloons 12 and 18 look like they are floating on strings to closely emulate a helium balloon arrangement without the use of helium. In fact, there is generally no need to have helium gas available to assemble the balloon arrangement. In some applications, the components may be plastic injected parts, which may reduce cost due to reduced labor in manufacturing and parts cost. Furthermore, these components may typically be placed in a small package with the balloons and other decorative accents for easy storage, shipping, or transport, yet create a full-size balloon arrangement when fully assembled. The kit comprises everything needed to assemble the balloon arrangement and may be able to be easily and quickly assembled. In some embodiments, the kit may be customizable to fit a variety of special occasions or circumstances and applications such as, but not limited to, centerpieces, balloon displays, party decorations, freestanding balloon decorations, party bags, gift bags, etc. Some embodiments may change how balloon arrangements are promoted and distributed, and may lessen or put an end to the need for helium in the balloon distribution industry. The kit may be sold in stores or online directly to the end user, who will be responsible for the assembly of the balloon arrangement and/or may be made available to party supply companies, flower shops, event planning firms, etc.

Figure 7:
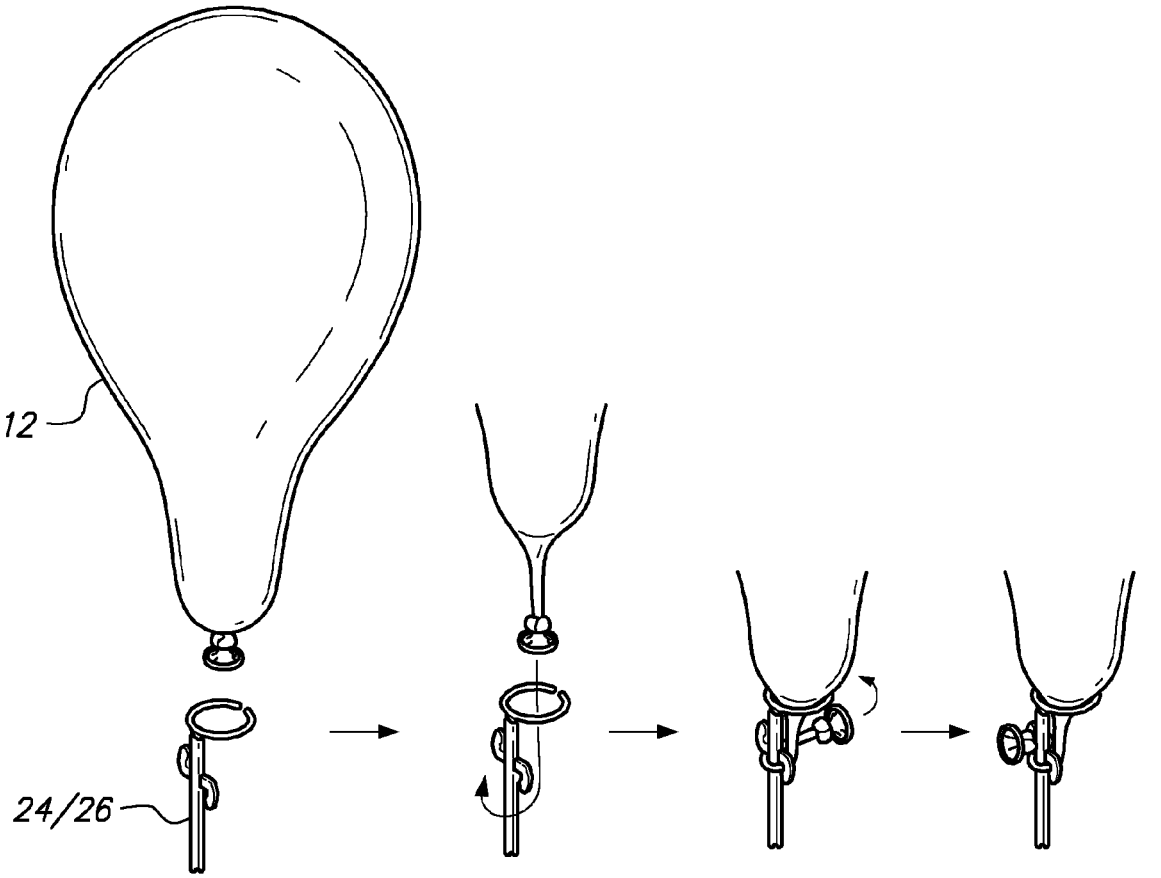
FIG. 7 and FIG. 8 illustrate a balloon being attached to an exemplary balloon hoop, in accordance with an embodiment of the present invention.
Figure 8:
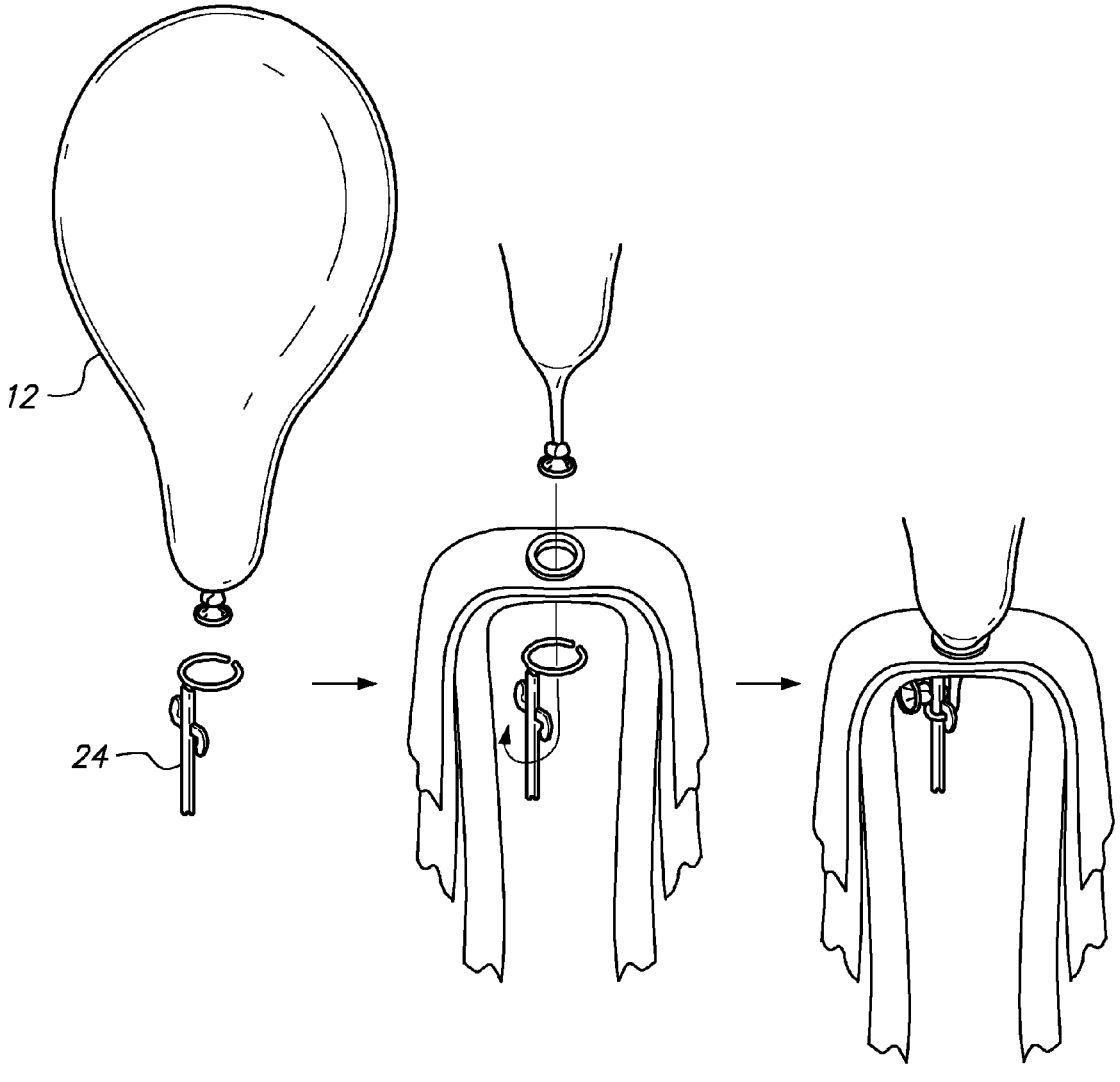

FIG. 7 and FIG. 8 illustrate a balloon 12 being attached to an exemplary balloon hoop 24, in accordance with an embodiment of the present invention. FIG. 7 is a side perspective view, and FIG. 8 is a side perspective view including, without limitation, a streamer assembly 14. In the present embodiment, balloon hoop 24 comprises a self-sealing balloon tie that typically eliminates the need to tie the latex balloons. To seal balloon 12, the tail of balloon 12 may be looped through the hoop and wrapped around the stem while being inserted into locking slots on the stem, which typically enables balloon 12 to remain inflated. As described in the foregoing, hoop 24 may be molded flat for storage and transport then may be folded by the end user to create a support for balloon 12. In some embodiments the hoop may be made in a bent shape. In some applications, the self-sealing balloon hoop may be may be made separately as a stand-alone product. The hoop may be used by balloon distributors and others that are currently selling and using standard balloon cups and sticks to potentially cut down on shipping and simplify assembly.

Figure 9:
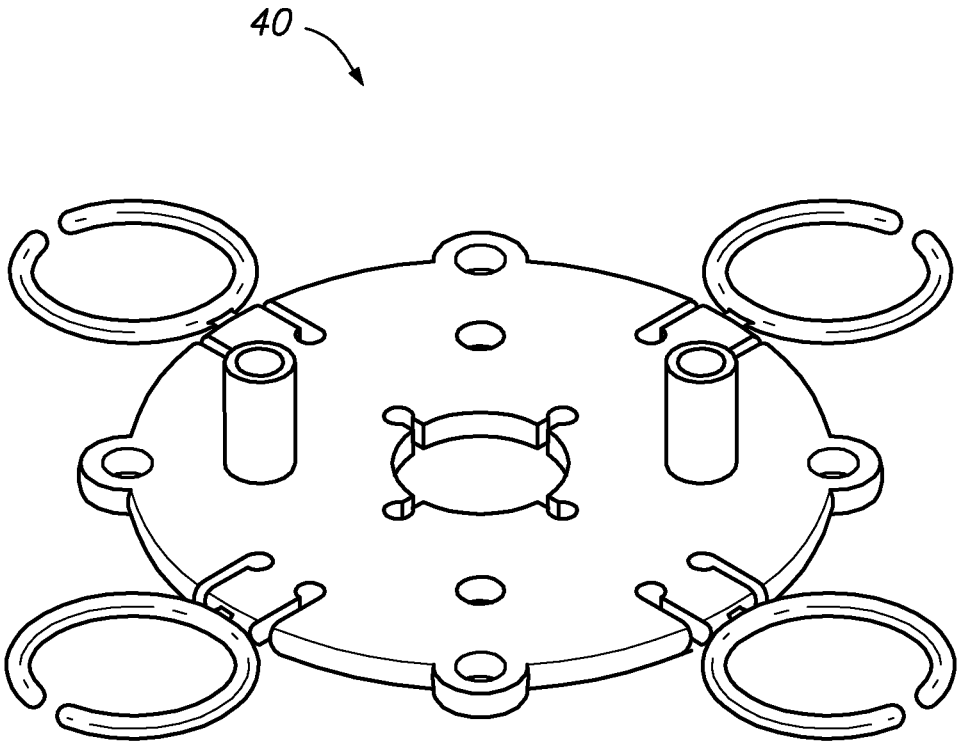
FIG. 9 illustrates a decorative balloon base, in accordance with an embodiment of the present invention.

FIG. 9 illustrates a decorative balloon base, in accordance with an embodiment of the present invention. In the present embodiment the decorative balloon base 40 has a variety of slots, holes, connectors, and folding hoops, each of which is used in a variety of balloon arrangement designs. When using the decorative base 40, the container 20 may not be needed. The balloon arrangement package with the decorative base once assembled may set on the floor or table. It may a variety of slots, holes, connectors, and folding hoops that can be used in a various ways to create the desired balloon shapes and configurations. In some embodiments, the decorative base may be stacked, or used individually to create a decorative support for a variety of balloon arrangements. Some embodiments may use the decorative balloon base in place of the gift bag 20 shown in FIG. 6. In some embodiments, the decorative base may have various slots, holes, and connectors that are aligned to allow the assembled stem system 22, shown in FIG. 4.

Figure 10:
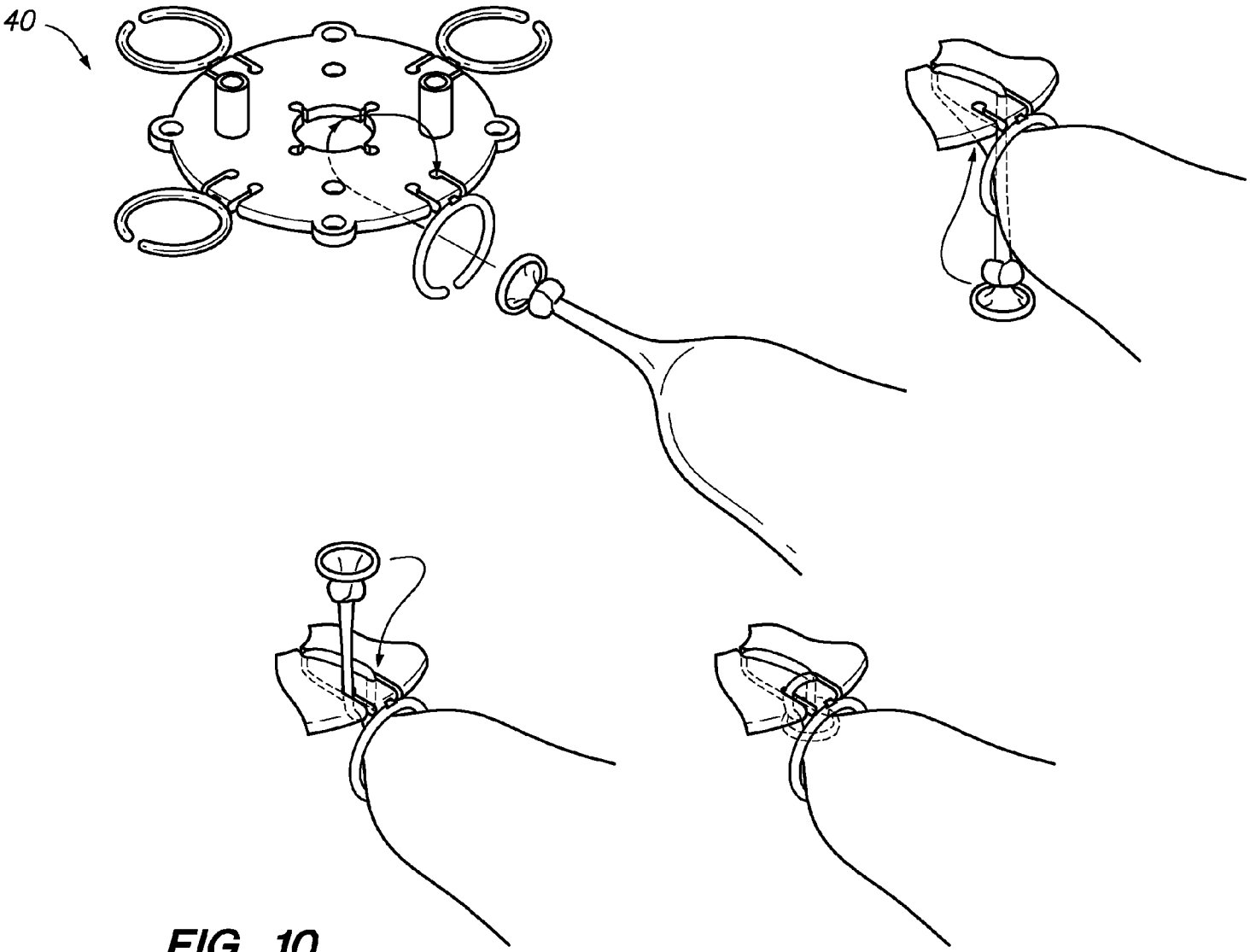
FIG. 10 illustrates a balloon being attached to an exemplary balloon hoop of a decorative balloon base, in accordance with an embodiment of the present invention.

FIG. 10 illustrates a balloon being attached to an exemplary balloon hoop of a decorative balloon base, in accordance with an embodiment of the present invention. In the present embodiment, with the self-sealing folding cup bent down, the balloon stem may be inserted and tied, as shown.

Figure 11:
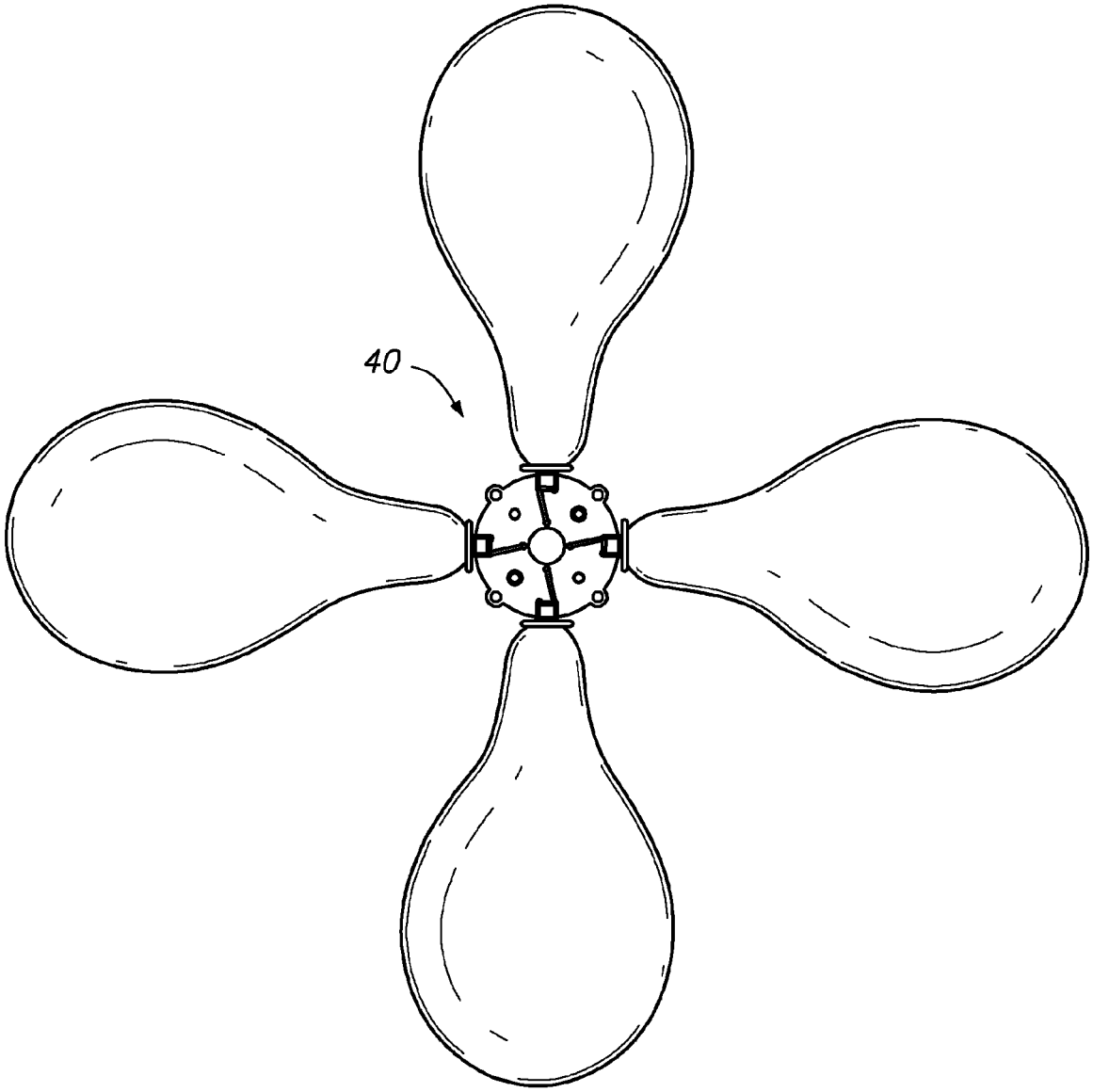
FIG. 11 illustrates a top view of a decorative balloon base assembled and positioned ready to accept balloon arrangement components.

FIG. 11 illustrates a top view of a decorative balloon base assembled and positioned ready to accept balloon arrangement components. In the present embodiment, four balloons are attached to balloons hoops positions around the periphery of the decorative balloon base 40. Other embodiments may have fewer or more balloon hoops. Some embodiments may include streamers 14 as shown in FIG. 6.

Figure 12:
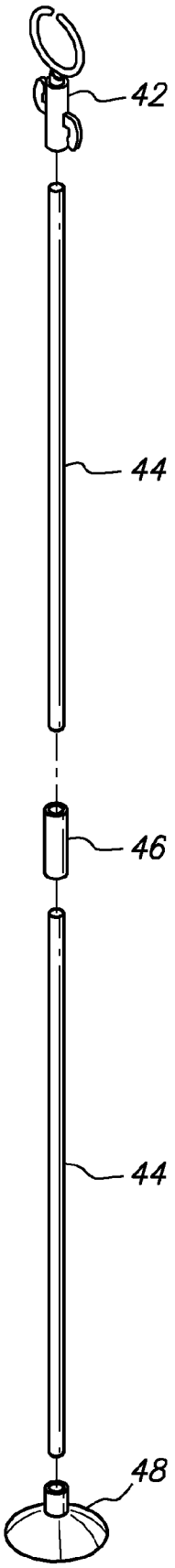
FIG. 12 illustrates components of an exemplary single stem self-sealing system for a balloon arrangement, in accordance with an embodiment of the present invention.

FIG. 12 illustrates components of an exemplary single stem self-sealing system for a balloon arrangement, in accordance with an embodiment of the present invention. In the present embodiment, self-sealing balloons hoop engages a stem rod 44. Stem rod connector 46 couples to another stem rod 44. Suction cup 48 serves as a base. Some embodiments may have only one stem rod 44. Other embodiments may have more than two stem rods 44 coupled together. Some embodiments may have different bases, such as, but not limited to, plates of various shapes, weighted objects, decorative bases, etc.

Figure 13:
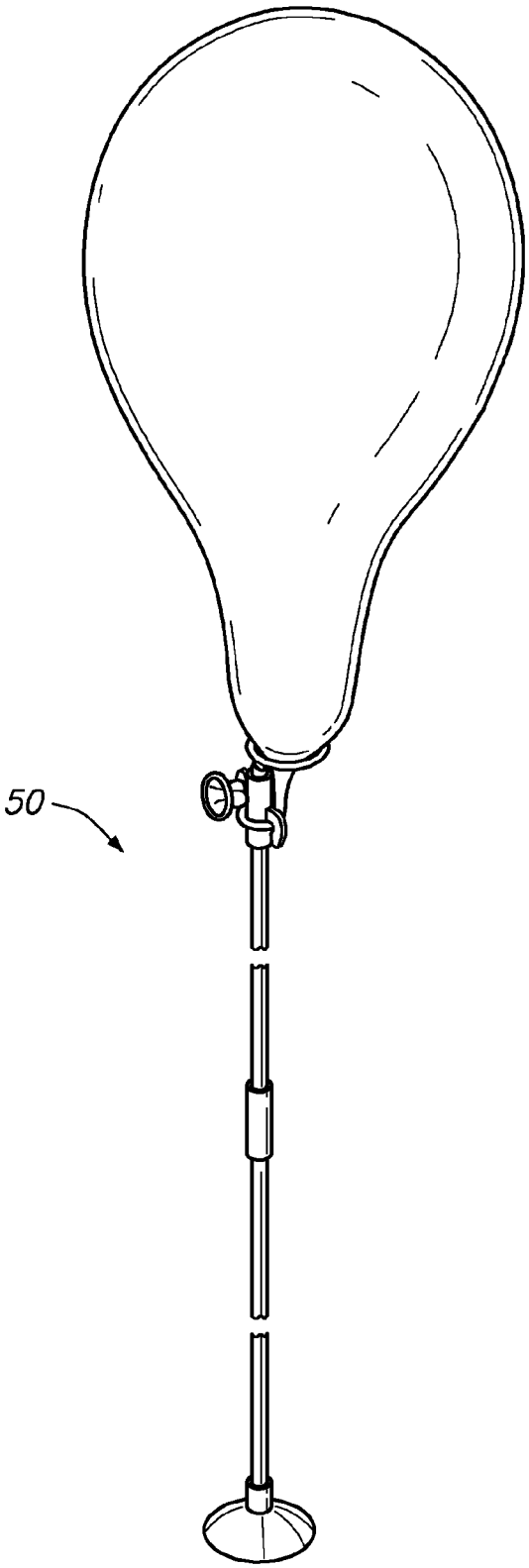
FIG. 13 illustrates an exemplary assembled single stem self-sealing system for a balloon arrangement, in accordance with an embodiment of the present invention.

FIG. 13 illustrates an exemplary assembled single stem self-sealing system for a balloon arrangement, in accordance with an embodiment of the present invention. Assembled arrangement 50 may be placed for example, but not limited to, on a floor, table or any other piece of furniture, Referring to FIG. 8, streamers 14 may be added to the assembly as an added decorative accent. In the present embodiment, multiple streamers may be connected by a grommet. To attach streamers 14 to the balloon arrangement, the tail of balloon 12 may be inserted through the grommet then through balloon hoop 24 and into the locking slots to hold balloon 12 and streamers 14 in place. The grommet typically enabled streamers 14 to swivel, which may facilitate the positioning of streamers 14 on the arrangement.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing an air-filled balloon arrangement assembly kit according to the present invention will be apparent to those skilled in the art. Various aspects of the invention have been described above by way of illustration, and the specific embodiments disclosed are not intended to limit the invention to the particular forms disclosed. The particular implementation of the air-filled balloon arrangement assembly kit may vary depending upon the particular context or application. By way of example, and not limitation, the air-filled balloon arrangement assembly kit described in the foregoing were principally directed to vertical implementations; however, similar techniques may instead be applied to balloon arrangements in various different configurations such as, but not limited to, heart-shaped arrangements, balloon arches, and large columns of balloons, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A balloon arrangement comprising:

a base member;

at least one stem unit being configured for removably engaging said base member;

at least one balloon hoop unit being configured for removably engaging said stem unit, said balloon hoop unit comprising a hoop portion being configured to rotate from a substantially flat position for storage to a substantially horizontal position for supporting a balloon, said balloon hoop unit further comprising a self-sealing balloon tie portion being configured for sealing a tail of a balloon; and at least one balloon being operable to be inflated by breathable air in which said self-sealing balloon tie portion seals a tail of said balloon inflated with the breathable air, and said hoop portion, in said supporting position, supports said balloon inflated with the breathable air in a position for simulating being held up by helium inflation.

2. The balloon arrangement as recited in claim 1, further comprising at least one connection unit and a plurality of additional stem units, said connection unit being configured for removably engaging said stem unit and said additional stem units.

3. The balloon arrangement as recited in claim 2, further comprising a plurality of additional balloon hoop units being configured for removable engaging said connection unit.

4. The balloon arrangement as recited in claim 3, further comprising a plurality of additional balloons being supportable by said plurality of additional balloon hoop units.

5. The balloon arrangement as recited in claim 1, further comprising a horizontal connection unit being configured for removably engaging said base member and said stem unit.

6. The balloon arrangement as recited in claim 5, further comprising a singular balloon hoop unit being configured to removable engage said horizontal connection unit substantially parallel to said stem unit.

7. The balloon arrangement as recited in claim 1, further comprising streamers being configured to removably engage said balloon and said balloon hoop unit.

8. The balloon arrangement as recited in claim 1, further comprising a gift bag for receiving said base member.

9. The balloon arrangement as recited in claim 8, further comprising tissue paper for placement in said gift bag.

10. The balloon arrangement as recited in claim 1, further comprising a weight being configured to be placed on said base member.

11. The balloon arrangement as recited in claim 10, in which said weight comprises a bag filled with a dry polymer powder configured to receive water to add weight.

12. The balloon arrangement as recited in claim 1, in which said base member further comprises a decorative component.

13. The balloon arrangement as recited in claim 12, in which said decorative component comprises a plurality of rotatable hoop portions and a plurality of self-sealing balloon tie portions.

14. The balloon arrangement as recited in claim 13, further comprising a plurality of decorative balloons for engaging said plurality of rotatable hoop portions and said plurality of self-sealing balloon tie portions.

15. The balloon arrangement as recited in claim 1, in which said base member comprises a suction cup.

16. A balloon arrangement comprising:

means for supporting the balloon arrangement on a surface;

means for extending upward from said supporting means, said extending means being configured for removably engaging said supporting means;

means for supporting and for sealing an inflatable item; and a balloon for inflating with breathable air in which said supporting and sealing means seals said balloon inflated with the breathable air, and supports said balloon inflated with the breathable air in a position for simulating being held up by helium inflation.

17. The balloon arrangement as recited in claim 16, further comprising a plurality of means for extending upward, a plurality of means for engaging said plurality of extending means, a plurality of means for supporting and for sealing an inflatable item and a plurality of balloons for inflating with breathable air in which said plurality of supporting and sealing means seals said plurality of balloons inflated with the breathable air, and supports said plurality of balloons inflated with the breathable air in positions for simulating being held up by helium inflation.

18. The balloon arrangement as recited in claim 16, further comprising means for receiving said supporting means.

19. The balloon arrangement as recited in claim 16, further comprising means for weighting said supporting means.

20. A balloon arrangement comprising:

a base member;

a plurality of stem units being configured for removably engaging said base member;

a plurality of connection units, said connection unit being configured for removably engaging said stem units;

a plurality of balloon hoop units being configured for removably engaging said stem units, each of said balloon hoop units comprising a hoop portion being configured to rotate from a substantially flat position for storage to a substantially horizontal position for supporting a balloon, each of said balloon hoop unit further comprising a self-sealing balloon tie portion being configured for sealing a tail of a balloon;

a plurality of balloon being operable to be inflated by breathable air in which said self-sealing balloon tie portions seal a tails of said balloons inflated with the breathable air, and said hoop portions, in said supporting position, support said balloons inflated with the breathable air in positions for simulating being held up by helium inflation;

a horizontal connection unit being configured for removably engaging said base member and at least one of said plurality of stem units;

a singular balloon hoop unit being configured to removable engage said horizontal connection unit substantially parallel to said at least one stem unit;

a plurality of streamers being configured to removable engage at least one of said balloons and said balloon hoop units;

gift bag for receiving said base member;

tissue paper for placement in said gift bag; and a weight being configured to be placed on said base member, said weight comprising a bag filled with a dry polymer powder configured to receive water to add weight.

* * * * *